US008555773B2

(12) United States Patent
Dreher et al.

(10) Patent No.: US 8,555,773 B2
(45) Date of Patent: Oct. 15, 2013

(54) RETAINING SEGMENT

(75) Inventors: Herbert Dreher, Horb (DE); Clemens Krebs, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 1009 days.

(21) Appl. No.: 12/599,527

(22) PCT Filed: May 14, 2008

(86) PCT No.: PCT/EP2008/003872

§ 371 (c)(1),
(2), (4) Date: Nov. 10, 2009

(87) PCT Pub. No.: WO2008/138606

PCT Pub. Date: Nov. 20, 2008

(65) Prior Publication Data

US 2010/0300281 A1 Dec. 2, 2010

(30) Foreign Application Priority Data

May 14, 2007 (DE) ..... 10 2007 022 568

(51) Int. Cl.
*F01B 3/02* (2006.01)

(52) U.S. Cl.
USPC ..... 92/12.2

(58) Field of Classification Search
USPC ..... 92/5 R, 12.2; 91/506; 74/839
See application file for complete search history.

(56) References Cited

U.S. PATENT DOCUMENTS

| | | | | |
|---|---|---|---|---|
| 3,373,696 | A * | 3/1968 | Geyer | 91/499 |
| 3,631,764 | A * | 1/1972 | Lucien | 91/506 |
| 3,779,137 | A | 12/1973 | Koivunen | |
| 5,960,697 | A * | 10/1999 | Hayase et al. | 92/12.2 |
| 6,354,809 | B1 * | 3/2002 | Fagerli et al. | 92/12.2 |
| 7,980,167 | B2 * | 7/2011 | Schwarzkopf et al. | 92/12.2 |
| 2005/0258147 | A1 | 11/2005 | Donders | |
| 2006/0251526 | A1 | 11/2006 | Belser | |
| 2007/0059529 | A1 * | 3/2007 | Hosenfeldt et al. | 428/408 |

FOREIGN PATENT DOCUMENTS

DE 36 26 619 A1 2/1988

* cited by examiner

*Primary Examiner* — F. Daniel Lopez
(74) *Attorney, Agent, or Firm* — Scully, Scott, Murphy & Presser, P.C.

(57) ABSTRACT

A retaining segment for retaining a back-up plate of a hydrostatic piston machine is disclosed. The retaining segment has a recess for an actuating element of an adjusting device and a retaining surface that extends along an arc section. A stop surface is formed on the retaining segment. The stop surface and the receiver for an actuating element are formed on opposing ends of the retaining segment and are oriented towards a side remote from a mounting surface.

13 Claims, 6 Drawing Sheets

RETAINING SEGMENT

BACKGROUND

The invention relates to a retaining segment for retaining a recoil plate of a hydrostatic piston machine.

In hydrostatic axial piston machines it is necessary to ensure, in particular during the intake stroke, that slide shoes, with which the pistons—mounted in a longitudinally displaceable manner—are supported on a running surface of a pivoting cradle, remain in contact with the running surface. For this purpose a recoil plate is used which engages around the slide shoes and thereby keeps them in contact with the running surface of the pivoting cradle. It is known to use retaining segments in order to fix the position of the recoil plate relative to the running surface of the pivoting cradle. These retaining segments also have a receiver for an actuating element and are fixedly connected to the pivoting cradle. In order to adjust the pivoting angle and therefore the stroke volume of the axial piston machines an adjustment device cooperates with the retaining segment via the receiver. The retaining segment, which is screwed to the pivoting cradle, therefore transfers the force produced by the adjustment device to the pivoting cradle and rotates it in a pivoting cradle bearing. Furthermore, it is known to provide a pressure feed-through in the retaining segment, via which pressure medium can be supplied for hydrostatic relief of the pivoting cradle. This pressure medium supply has a pressure medium input. This pressure medium supply is disposed on the retaining segment in such a way that it lies in the pivot axis of the pivoting cradle when the retaining segment is in the mounted condition. Pressure medium can therefore be supplied by means of a separate pressure supply rod in order to relieve the pivoting cradle.

In order to retain the recoil plate a retaining surface is formed on the retaining segment and extends along a portion of a circular arc. When the retaining segment is in the mounted condition this retaining surface lies on the recoil plate and therefore prevents the recoil plate from being lifted off.

In order to ensure emergency running properties of the axial piston machine the known retaining segments are produced from brass or bronze. The emergency running properties of brass or bronze are known. However, since brass or bronze is a relatively soft material the functionality of the retaining segment can be limited merely to the above-described functions such as the transfer of a low adjustment force and the retaining of the recoil plate. This means, however, that additional functions, such as for example coupling in of a high pressure displacement and a pivoting angle limitation, have to be provided at other points of the axial piston machine. This therefore ultimately leads to an enlargement of the construction size of the axial piston machine.

SUMMARY

It is the object of the invention to create a retaining segment which permits greater integration of functions of the axial piston machine.

The retaining segment in accordance with the invention is provided to retain a recoil plate of a hydrostatic piston machine. It has a receiver for an actuating element of a displacement device and a retaining surface which extends along a portion of a circular arc. At least one stop surface [is] to be formed on the retaining segment in accordance with the invention. A stop surface such as this can cooperate with an adjustable stop, for example, in order to limit the movement of the pivoting cradle. Since, during approach to the end position of the pivoting cradle by means of the force of a high pressure displacement device the pivoting cradle or the retaining segment is pressed against the adjustment screw of the limiting device, the retaining segment is subjected to considerable loading at this stop surface.

It is also advantageous to form the stop surface and the receiver for the actuating element on opposing ends of the same retaining segment and to orientate them towards a side remote from a mounting surface of the retaining segment. By means of such an arrangement of the receiver for an actuating element and of the stop surface for limiting the movement of the pivoting cradle, a favourable introduction of force into the retaining segment and therefore ultimately into the pivoting cradle is achieved. The introduction of force is effected at the same component both for the adjustment force and also for the limiting force. The stop surface is preferably formed in a crown-shaped manner. The centre point of the crowning lies on the side of the stop surface facing the mounting surface of the retaining segment. By means of such an arrangement of the centre point of the crowning and a crown-shaped formation of the stop surface it is achieved that the introduction of force, which is effected through the limiting device, can be directed through the centre point of the crowning. In relation to the pivoting cradle the force is therefore always introduced in the same manner and in particular independently of the set pivoting cradle limitation.

Furthermore, it is preferable to provide still greater integration of the functionalities into the retaining segment. For this purpose a further stop surface is formed on the retaining segment and is provided on the same side of the retaining segment as the receiver for the actuating element. This further stop surface is preferably orientated in the same manner as the mounting surface of the retaining segment. The receiver and the further stop surface are therefore disposed in opposite directions on the same end of the retaining segment.

The portion of the circular arc along which the retaining surface extends preferably has an angle of contact of about 90 degrees. With such an opening angle there is a favourable ratio of weight to contact surface between the recoil plate and the retaining segment. When mounting the retaining segment on the pivoting cradle it is therefore ensured that the recoil plate is pressed against the retaining surface of the retaining segment during the most powerful stroke movement and therefore the greatest force transfer to the recoil plate during an intake stroke of a piston. In the region of the maximum force transfer to the recoil plate the recoil plate is therefore supported via the retaining surface. During further revolution of the recoil plate the necessary forces for holding the slide shoe on the running surface of the pivoting cradle become smaller or even act in the opposite direction. Consequently the formation of a retaining surface with an angle of contact of about 90 degrees is sufficient to reliably prevent deformation of the recoil plate.

During operation of an axial piston machine a lubricant film is built up on the recoil plate between the retaining surface of the retaining segment and the corresponding slide surface. In order to promote the formation of such a lubricant film between the surface of the recoil plate and the retaining surface an inclined surface portion is formed on the retaining segment on at least one end of the retaining surface so that the distance between the mounting surface and the retaining surface increases towards the end of the retaining surface. An inclined surface of this type can be provided at both ends of the retaining surface in particular if the retaining segment is provided for use in an axial piston machine provided for two rotational directions. Such inclined surface portions of this type favour the entry of pressure medium which is located on the retaining plate and therefore improves the formation of a lubricant film between the recoil plate and the retaining segment.

The retaining segment in accordance with the invention is preferably produced from tempered steel and is nitrocarburized and oxidized. The tempering, nitrocarburizing and oxidizing of the steel of the retaining segment produces a high level of strength and wear resistance in the component. Thereby not only can the retaining function be achieved for the recoil plate but further functions can be integrated into the retaining segment such as the transfer of the forces introduced through the high-pressure displacement device and the stops. However, nitrocarburizing alone without a lubricant film could result in deterioration of the sliding properties of the retaining segment on the retaining surface and the receiver of the adjustment piston. The retaining segment is therefore additionally oxidized. In so doing, the oxidation of the nitrocarburized steel produces a good sliding property and good run-in behaviour of the retaining segment. Only in this way is it possible—in spite of possible integration of further functions—to ensure that the retention of the recoil plate, in particular also during the start-up phase of the axial piston machine, does not lead to increased friction between the retaining segment and the recoil plate.

By using a nitrocarburized steel which is oxidised it is possible to integrate the functions of retaining the recoil plate and the function of pivoting angle limitation by the stop surface into the retaining segment.

It is also advantageous that the retaining segment comprises a retaining surface. This retaining surface is formed from a brass or bronze material. Alternatively, it can be advantageous to form the retaining surface from a synthetic material substance.

In accordance with a further preferred embodiment the whole retaining segment can consist of brass or bronze or even of a synthetic material. The formation of parts or of the whole retaining segment from brass or bronze or synthetic material has the advantage of improving the emergency running properties of a piston machine in which the retaining segment in accordance with the invention is disposed. Also, when no lubricant is present the service life of the axial piston machine is therefore considerably increased.

In accordance with a further advantageous development a magnet is provided on the retaining segment. This magnet serves to detect the pivoting angle of the pivoting cradle and therefore permits a conclusion to be drawn about the set delivery volume or slip volume of the piston machine. It is particularly preferred if the magnet is connected to the retaining segment in such a way that the magnet is disposed in a pivot axis S or at least in the proximity of a pivot axis S. The position of the magnet is thus largely maintained during rotation of the pivoting cradle about the pivot axis S so that detection can be easily effected by rotation of the magnet, for example with the aid of a Hall sensor.

BRIEF DESCRIPTION OF THE DRAWINGS

A preferred exemplified embodiment is explained in more detail in the following description with reference to the attached drawings in which.

DETAILED DESCRIPTION OF EXEMPLARY EMBODIMENTS

Figure 1:
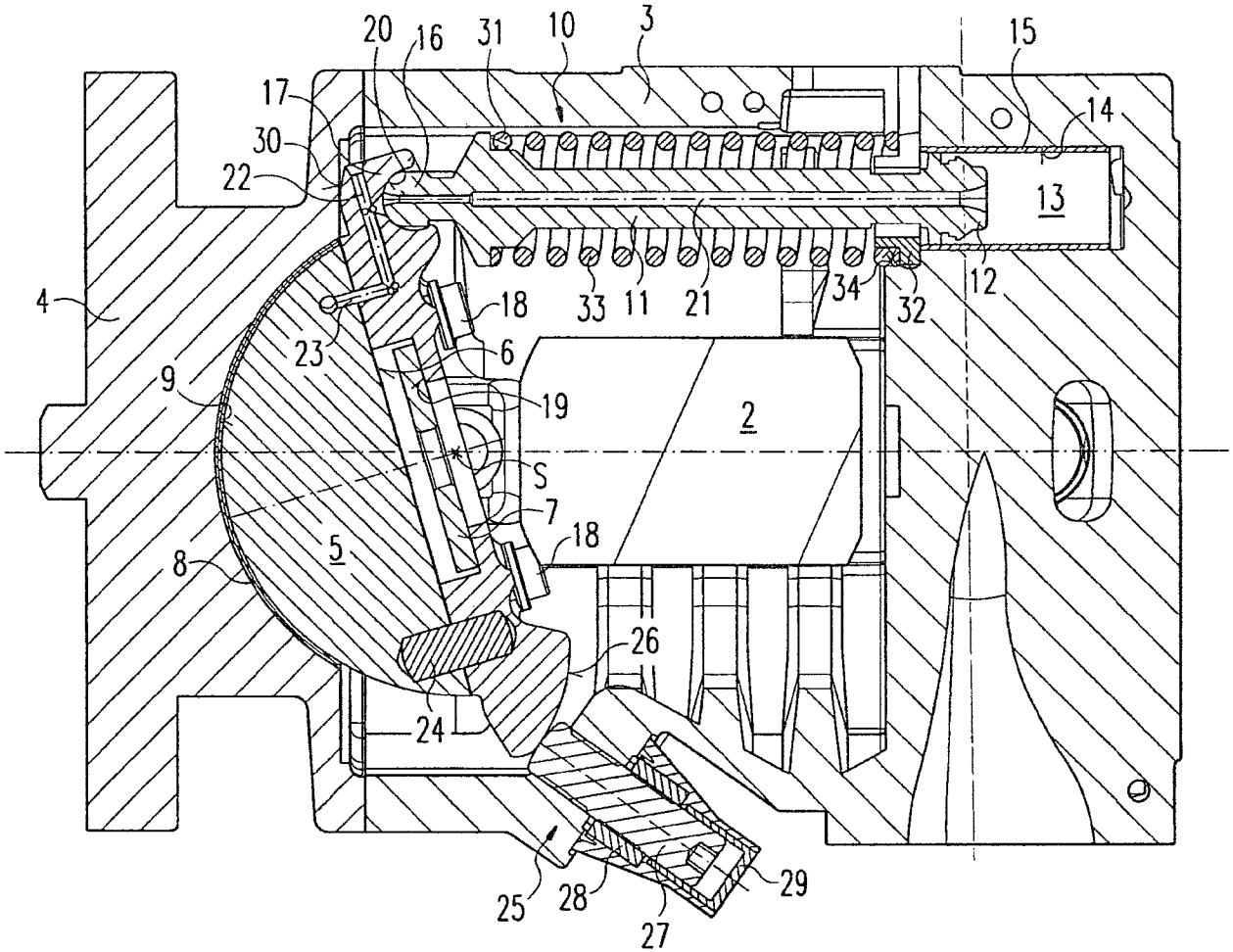
FIG. 1 shows a longitudinal section through an axial piston machine with the retaining segment in accordance with the invention.

FIG. 1 shows a sectional illustration of an axial piston machine 1 in accordance with the invention, wherein the sectional plane extends in parallel with an axis of rotation of the axial piston machine 1 but off-centre. The axial piston machine 1 comprises a cylinder drum 2 in which several cylinder bores are disposed distributed over a peripheral circle in a manner not shown. Pistons are disposed in the cylinder bores in a longitudinally displaceable manner and deliver a pressure medium by way of their stroke movement when the illustrated axial piston machine 1 is a pump.

The axial piston machine 1 comprises a housing which consists of a first cup-shaped housing part 3 and a second housing part which is formed as a flange part 4. A drive shaft which cannot be seen in FIG. 1 is mounted in a rotatable manner in the flange part 4 and the first cup-shaped housing part 3 and is connected in a rotationally-fixed manner to the cylinder drum 2. When the drive shaft rotates, the cylinder drum 2 is caused to rotate owing to the rotationally-fixed connection. The longitudinally displaceable pistons disposed in the cylinder drum 2 are supported in a known manner on a pivoting cradle 5 via slide shoes. For this purpose the pivoting cradle 5 comprises a running surface 6. In order to prevent the slide shoes lifting from the running surface 6 of the pivoting cradle 5 during an intake stroke, a recoil plate 7 is provided. The recoil plate 7 is kept at a fixed distance from the running surface 6 of the pivoting cradle 5 and thus prevents the slide shoes lifting from the running surface 6. In order to permit a rotational movement of the pivoting cradle 5, the slide shoes are connected to the pistons in an articulated manner. In dependence upon the inclined position of the pivoting cradle 5 the pistons in the cylinder drum 2 thus carry out a stoke of a different size per rotation of the drive shaft or the cylinder drum 2.

On its side facing the flange part 4 the pivoting cradle 5 comprises a pivoting cradle bearing 8. For this purpose at least one first bearing region is formed on the pivoting cradle 5 and forms a slide bearing with a corresponding recess 9 in the flange part 4. The formation of the pivoting angle bearing of the pivoting cradle 5 will be explained further hereinafter with reference to FIGS. 2 and 6.

The pivoting cradle 5 can be rotated about a pivot axis S by turning of the pivoting cradle 5 in the pivoting cradle bearing.

The tilt of the running surface 6 relative to the axis of rotation of the cylinder drum 2 thereby changes.

In order to adjust the tilt of the pivoting cradle 5 and thus the stroke of the pistons in the cylinder drum 2 during a rotation of the cylinder drum 2, an adjustment system is provided inside the housing of the axial piston machine 1. The adjustment system includes at least one first adjustment device 10. The first adjustment device 10 comprises a first adjustment piston 11. The first adjustment piston 11 defines a pressure chamber 13 with its first end 12. The pressure chamber 13 is formed in a base of the cup-shaped housing part 2. In order to form the pressure chamber 13 a blind bore 14 is incorporated in the base of the cup-shaped housing 3 and a sleeve 15 is inserted therein. The sleeve 15 is preferably pressed into the blind bore 14. The inner wall of the sleeve 15 is used as a slide surface for the first end 12 of the adjustment piston 11 and cooperates in a sealing manner with the first end 12 of the first adjustment piston 11. The first end 12 of the adjustment piston 11 is not foamed in a cylindrical manner but rather has a slightly crowned shape in order to prevent tipping in the sleeve 15 when the adjustment piston 11 is in an inclined position relative to the longitudinal axis of the sleeve 15. A sealing ring could also be disposed in the crown-shaped region of the first end 12 of the adjustment piston 11.

A spherical head is formed on a second end 16 of the adjustment piston 12 remote from the first end 12. The spherical head is connected to a retaining segment 17 such that tractive forces and also compressive forces can be transferred. The retaining segment 17 is fixedly connected to the pivoting cradle 5 by means of screws. The retaining segment 17 is screwed onto the running surface 6 in an outer region of the pivoting cradle 5. The retaining segment 17 also comprises a retaining surface 19 which engages over the recoil plate 7 and lies against the recoil plate 7 and thus ensures that the recoil plate 7 is kept at a constant distance from the running surface 6 of the pivoting cradle 5.

In order to attach the spherical head-shaped second end 16 of the adjustment piston 11, a spherical recess 20 is provided in the retaining segment 17 and encloses the spherical head-shaped second end 16 of the adjustment piston 11. The connection of the adjustment piston 11 to the retaining segment 17 is designed as a locked connection, i.e., the spherical head-shaped second end 16 is enclosed by the spherical recess of the retaining segment further than the equator.

A lubricant channel 21 is formed within the adjustment piston 11 in the first adjustment device 10. The lubricant channel 21 extends from the first end 12 of the adjustment piston 11 to the second end 16. The lubricant channel 21 thus connects the pressure chamber 13 to the spherical head-shaped second end 16 of the adjustment piston 11. A pressure prevailing in the pressure chamber 13 is thus sufficient for discharging pressure medium at the spherical head-shaped second end 16 of the adjustment piston 11. The articulated connection between the adjustment piston 11 and the retaining segment 17 is thus lubricated and hydrostatically relieved.

It may be assumed in FIG. 1 that the first adjustment device 10 is provided for pivoting the axial piston machine 1 in the maximum displacement volume direction. The pressure chamber 13 is connected for this purpose to the conveying side of the axial piston machine 1 designed as a pump. The high pressure present in the pressure chamber 13 is further used in order to hydrostatically relieve the pivoting cradle 5 in the flange part 4. For this purpose a pressure medium channel 22 and 23 is formed in the retaining segment 17 and also in the pivoting cradle 5 respectively. The pressure medium channel 23 of the pivoting cradle 5 is connected to the bearing region 8 outside the sectional view illustrated in FIG. 1 in a manner not shown. The pressurised pressure medium originating from the pressure chamber 13 is thus discharged between the recess 9 and the bearing region 8 of the pivoting cradle 5 and is thus sufficient for hydrostatically relieving the pivoting cradle 5. This results in a considerable reduction of the necessary actuation forces.

In order to enable positioning of the retaining segment 17 relative to the pivoting cradle 5, an alignment pin 24 is provided which is inserted into a bore in the pivoting cradle 5 and into a corresponding bore in the retaining segment 17. Furthermore, in the region of an end of the retaining segment 17 remote from the ball-and-socket joint connection between the adjustment piston 11 and the retaining segment 17, an adjustable first limiting device 25 is provided in the cup-shaped housing part 3. The first limiting device 25 co-operates with a first stop surface 26 which is formed on the retaining segment 17. The first stop surface 26 is designed to be crown shaped which means that, independent of the adjustment of the first limiting device 25, the force is applied through the limiting device 25 to the first stop surface 26 in a perpendicular manner and thus through the centre point of the crowning. The centre point of this crowning is located in the direction of the pivoting cradle 5 as viewed from the stop surface.

The first limiting device 25 includes an adjusting screw 27 which is screwed into a housing bore in a thread provided for that purpose. In dependence upon the screw-in depth, the maximum deflection of the pivoting cradle 5 in a first direction of movement is fixed by the first limiting device 25. The housing bore is disposed in the region of the boundary surface of the cup-shaped housing part 3. It forms, with the axis of rotation, an angle such that the centre axis of the adjusting screw 27 extends through the centre point of the crowning of the stop surface 26.

The first adjustment device 10, the first limiting device 25 and the first retaining segment 17 are all assigned to a first direction of movement of the pivoting cradle 5. Whilst the first adjustment device 10 attempts to displace the pivoting cradle 5 in a first direction of movement, the first limiting device 25 is used as an adjustable stop and thus defines the maximum displacement in this first direction of movement. In order to keep the adjusting screw 27 in a selected position, a counternut 28 is provided. The counternut 28 is simultaneously used to seal the housing interior with respect to the surrounding area. The safety cap 29 prevents unauthorised changing of the adjustment values.

In order always to ensure the safety of the axial piston machine 1, even in the case of an inadvertent displacement of the adjusting screw 27, a further stop surface 30 is also formed on the same end of the retaining segment 17 on which the ball-and-socket connection between the second end 16 of the adjustment piston 11 and the first retaining segment 17 exists. The further stop surface 30 is formed on the side facing the flange part 4 and co-operates with a counterpart of the flange part 4 to form a safety stop. Therefore, even when the adjusting screw 27 is completely screwed out, displacement can occur merely until contact with the safety stop.

During displacement of the axial piston machine 1 in the maximum stroke volume direction, the safety stop is preferably formed between the flange part 4 and the further stop surface 30 of the first retaining segment 17.

The first adjustment device 10 and the first limiting device 25 are, as can be seen directly from FIG. 1, disposed in a plane which extends in parallel with the axis of rotation of the cylinder drum 2 and in particular perpendicular to the pivot axis S of the pivoting cradle 5. The force direction for introducing the adjustment force through the first adjustment device 10 and also the force direction when stopping against the adjustable first limiting device 25 are thus also in the plane formed in parallel with the axis of rotation. Since this plane extends simultaneously through a first bearing region formed on the pivoting cradle 5 and the flange part 4, torsional forces on the pivoting cradle 5 are obviated.

In order to bias the axial piston machine 1 in the maximum displacement volume direction, even in the event of the pressure chamber 13 having no pressure, a resilient element is provided on the first adjustment device 10. The resilient element is designed as a spring 33 in the illustrated exemplified embodiment. The spring 33, which is preferably a steel helical spring, is supported on the one hand on a first spring bearing 31 formed in the proximity of the second end 16. The spring bearing 31 is formed as a radial shoulder in the adjustment piston 11 and comprises a guide section for centring the spring 33, said guide section extending in the axial direction slightly in the direction of the first end 12 of the adjustment piston 11. On the opposite end of the spring 33, the spring 33 lies against a second spring bearing 32. The second spring bearing 32 is slit in a c-shape and, when the spring is compressed, is pushed laterally onto the adjustment piston 11. The second spring bearing 32 is supported against the piston end 12. The spring bearing 32 also comprises a guide section which extends in the axial direction. The spring bearing 32 is disposed in a centring recess 34 of the housing part 3 and at that location lies against the base of the cup-shaped housing part 3. The spring bearing 32 preferably simultaneously lies against the base of the cup-shaped housing 3 at the bottom of the centring recess 34 and against the end of the sleeve 15 oriented towards the interior of the housing of the axial piston machine 1.

FIG. 1 illustrates a sectional view [of the] the plane defined by the first adjustment device 10 and the first adjustable limiting device 25. The first adjustment device 10 is provided for displacing the axial piston machine 1 in the larger stroke volume direction and can be referred to as a pivoting device. This is the case when the axial piston machine 1 is used as a hydraulic pump for example, in the open circuit and is provided for the purpose of delivery in only one direction.

In the axial piston machine 1 a second adjustment device 35 is also provided which, however, cannot be seen in the illustration of FIG. 1 because of the placement of the cross-sectioning. The second adjustment device 35 also has a second variable limiting device 39 and corresponds substantially to the first adjustment device 10. The second adjustment device 35 and the second limiting device 39 are also in turn disposed in a common plane, wherein this further plane lies in parallel with the plane of the first adjustment device 10 and of the first limiting device 25. Both planes preferably lie symmetrically to the axis of rotation of the cylinder drum 2.

Figure 2:
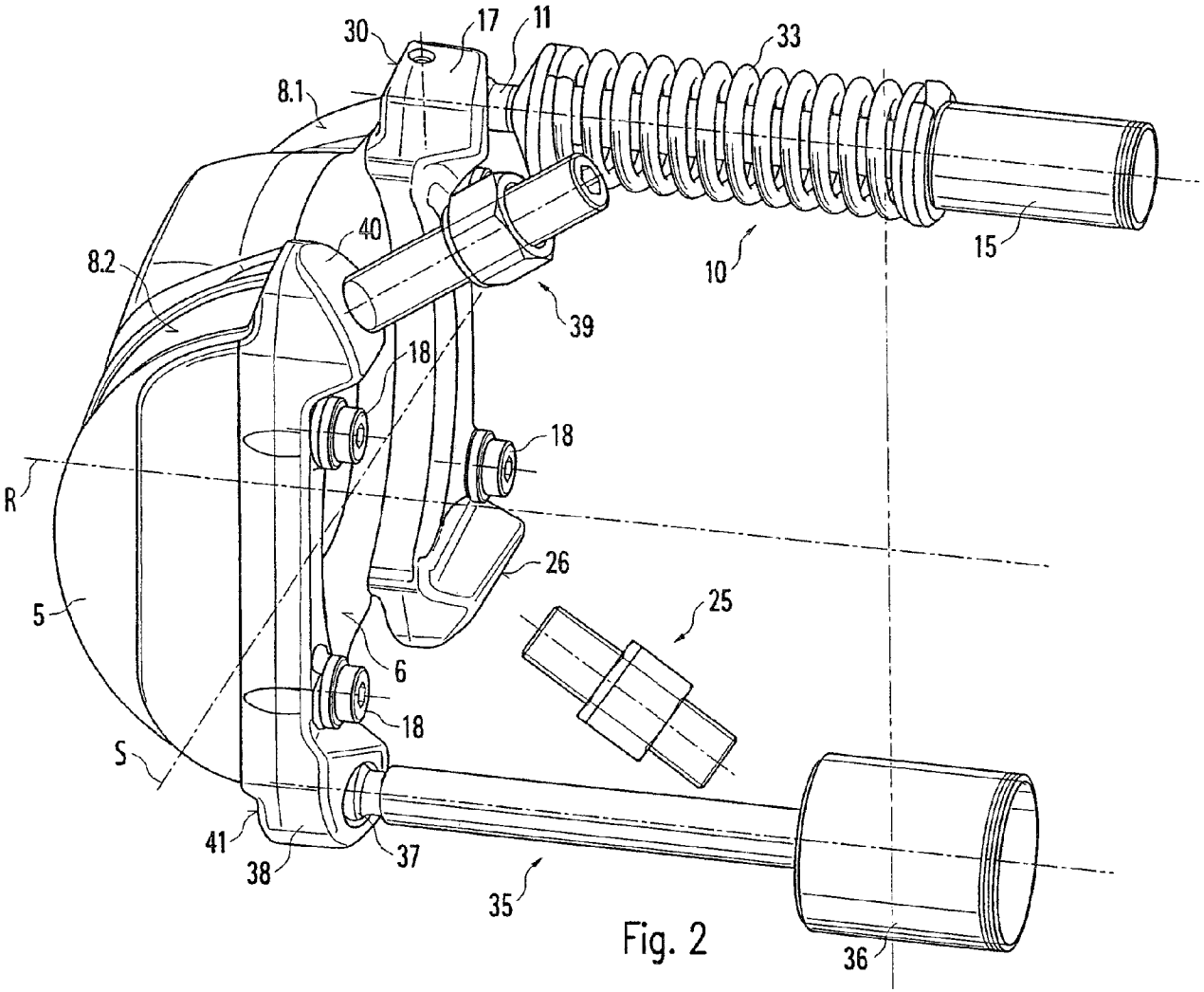
FIG. 2 illustrates an adjustment system of the axial piston machine of FIG. 1 with a first adjustment device and a second adjustment device and using a first retaining segment and a second retaining segment.

This arrangement is shown in FIG. 2, in which the individual components of the adjustment system are again shown in a perspective view. Thus, for the sake of easier understanding, the components of the axial piston machine 1 not relevant to the adjustment system have been left out.

It is to be noted that the first adjustment device 10 and the second adjustment device 35 lie on opposite sides with respect to the axis of rotation. The second adjustment device 35 of the adjustment system also has an adjustment piston which is mounted with its first end in a second sleeve 36. The second sleeve 36 is also inserted in a blind bore in the base of the cup-shaped housing part 3. Therefore a second pressure chamber is formed in the sleeve 36, which is closed by the base of the cup-shaped housing part 3 as in the case of the first adjustment device 10. The pressure chamber(s) is/are defined by a similarly crown-shaped adjustment piston disc. Over the whole displacement path of the adjustment system the respectively crown-shaped adjustment piston disc of both the adjustment piston 11 and also of the adjustment piston of the second adjustment device 35 is guided in the sleeve 15 and/or the further sleeve 36. At the other end of the adjustment piston of the second adjustment device 35 a ball-and-socket joint connection is also farmed. The second end 37 of the adjustment piston of the second adjustment device 35 is also inserted into a spherical recess in the second retaining segment 38. The second retaining segment 38 is connected, like the first retaining segment 30, to the pivoting cradle 5 by means of screws 18. The first and the second retaining segment 17 and 38 are preferably identical in formation. The first retaining segment 17 extends substantially along the plane in which the first adjustment device 10 and the first limiting device 25 are disposed. In a corresponding manner the second retaining segment 38 extends substantially along a further plane in which the second adjustment device 35 and a second variable limiting device 39 are disposed. The second variable limiting device 39 corresponds in construction to the first variable limiting device 35 so that another description will not be given.

If a cross-section through the axial piston machine 1, which typically comprises a housing with a rectangular or square cross-section, is considered, the adjustment devices 10 and 35 are disposed on a first diagonal in the region of the inner corners of the housing and the adjustable limiting devices 25 and 39 are disposed on a second diagonal in the region of the inner corners of the housing. If, in such a cross-section, the axial piston machines are divided into 4 quadrants, then the first adjustment device 10 is disposed in the first quadrant, the first limiting device 25 is disposed in the fourth quadrant, the second adjustment device 35 is disposed in the third quadrant and the second adjustable limiting device 39 is disposed in the second quadrant.

On the second retaining segment 38 a stop surface 40 is also formed, which is crown-shaped. As in the case of the first retaining segment 30, the crown-shaped formation of the stop surface 40 ensures that force is always introduced perpendicular to the stop surface 40 regardless of the selected adjustment of the variable limiting device 39. In order to form a safety stop a further stop surface 41 is also formed on the second retaining segment 38. The further stop surface 41 is formed on the same end of the second retaining segment 38 as the ball-and-socket joint connection to the adjustment piston of the second adjustment device 35.

FIG. 2 shows that the pivoting cradle bearing 8 of the pivoting cradle 5 is formed by a first bearing surface 8.1 and a second bearing surface 8.2. The first bearing surface 8.1 extends over a width in the direction of the pivot axis S so that the plane in which the first adjustment device 10 and the first adjustable limiting device 25 are disposed, i.e. in which the force directions through the first adjustment device 10 and the first adjustable limiting device 25 lie, extends through the first bearing surface 8.1. In a corresponding manner, the second bearing surface 8.2 also extends over a width in the direction of the pivot axis S so that the further plane, in which the second adjustment device 35 and the second limiting device 39 are disposed, extends through the region of the second bearing surface 8.2.

The two retaining segments 17, 38 are formed identically. A retaining segment 17, 38 of this type is shown in perspective on an enlarged scale in FIG. 3. The retaining segment 17, 38 has a substantially rod-shaped geometry. At a first end 45 the receiver for the actuating element of the first adjustment device 10 is formed. In the case of the illustrated axial piston machine 1 the adjusting piston 11 is the actuating element. The receiver is formed as a spherical recess 20. The spherical recess 20 is attached to an outwardly tilted surface and thus encloses the spherical head-shaped formation—provided for insertion—of the second end 16 of the adjustment piston 11 to such an extent that tractive and compressive forces can be transferred. For this purpose an undercut is formed on the adjustment piston 11 at the transition between the spherical head geometry and an adjustment piston shaft and permits pivoting of the adjustment piston 11 relative to the retaining segment 17 in the functional plane through the adjustment device and limiting device, in addition, the spherical end 16 of the adjustment piston is cylindrically flattened at the ball equator to form a smaller diameter, so that in a tilted condition the spherical head can be inserted into the recess 20. For this purpose tilting of the adjustment piston 11 transverse to the functional direction is required, i.e. outside the functional plane. During normal operation, on the other hand, an angle such as this between the retaining segment 17 and the adjustment piston 11 is not achieved so that it is not possible for the spherical head-shaped second end 16 of the adjustment piston 11 to slide out of the recess 20.

Figure 3:
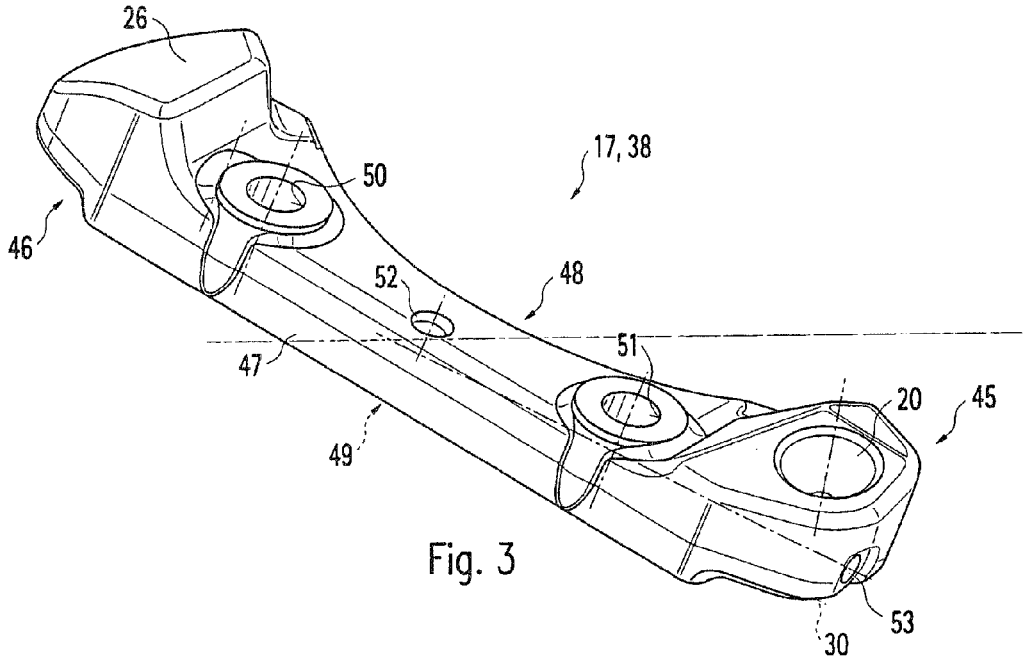
FIG. 3 shows a first perspective view of a retaining segment in accordance with the invention.

The crown-shaped stop surface 26 is formed at the second end 46 remote from the first end 45 of the retaining segment 17. In FIG. 3 the centre point of the crown-shaped geometry of the stop surface 26 lies below the stop surface 26 and therefore on the side of the stop surface 26 facing the running surface 6 of the pivoting cradle 5. The region of the retaining segment 17, 38 connecting the first end 45 to the second end 46 is formed as a straight line on one side. Thus, a planar side surface 47 is formed on the retaining segment 17, 38. In contrast, the side surface remote therefrom—which during mounting on the pivoting cradle 5 is oriented in the direction of the centre point of the pivoting cradle 5 or its running surface 6—is formed with a curvature 48. The curvature 48 or the retaining surface 19 formed at that location is explained in more detail hereafter with reference to FIG. 5.

A mounting surface 49 is provided in order to mount the retaining segment 17, 38 on the running surface 6 of the pivoting cradle 5. The mounting surface 49 is formed as a planar surface and extends over a large part of the whole length of the retaining segment 17, 38. The whole retaining segment 17, 38 is formed slightly longer than the contact surface with the pivoting cradle 5, so that the first end 45 and the second end 46 protrude slightly over the pivoting cradle 5. Therefore the force is supplied via the variable limiting device both to the stop surface 26 and to the adjusting force via the recess 20 with a relatively large leverage so that even comparatively small forces are sufficient to reliably permit an adjustment movement or a limitation of the adjustment movement. The pivoting cradle 5 itself as a whole can therefore be formed smaller, which leads to a reduction in the total weight of the axial piston machine 1.

In order to achieve reliable operation of the axial piston machine 1 the retaining segment 17, 38 in accordance with the invention is formed from tempered steel. This steel is nitrocarburized and oxidised. By tempering and nitrocarburizing the steel a high level of strength and/or wear resistance and surface hardness of the component are achieved. Such a high level of strength means that the stop surface 26 can be formed on the retaining segment 17, 38. Even with continuous operation the stop surface 26 does not wear to such a degree that this could lead to a change in the end position of the pivoting cradle 25. This is also advantageous in particular as far as safe operation of the axial piston machine 1 operating under considerable pressures is concerned.

The length of the retaining segment 17, 38 additionally makes it possible to provide a further stop surface 30 on the side of the first end 45 of the retaining segment 17, which side is oriented identically to the mounting surface 49. This further stop surface 30 cooperates with a counterpart which is formed in the housing of the axial piston machine 1. The further stop surface 30 forms therewith a safety stop, whereby all the forces influencing the position of the pivoting cradle 5 are applied exclusively at the retaining segment 17, 38.

Figure 4:
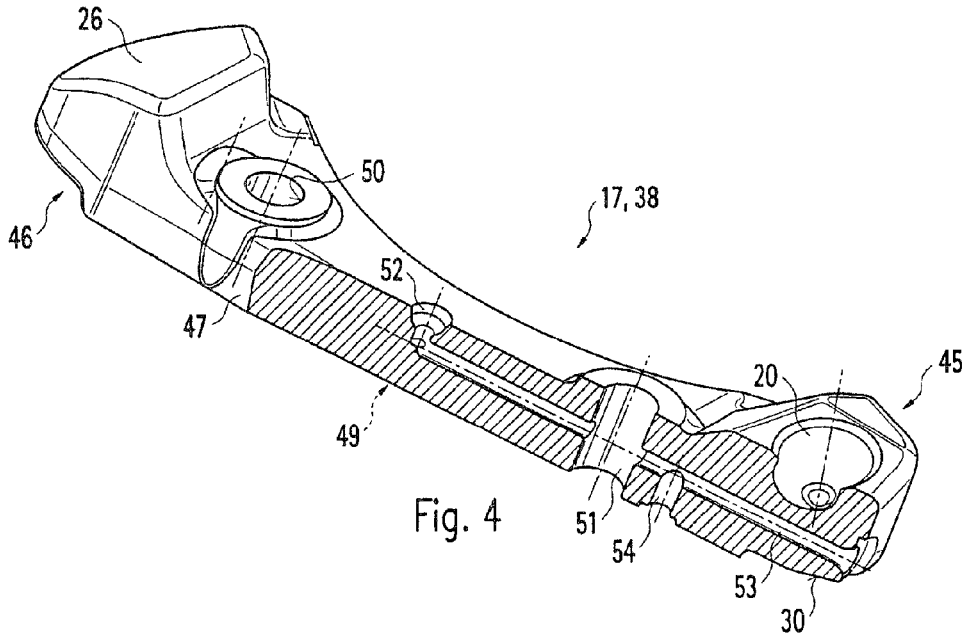
FIG. 4 shows a second partially cut away view of a retaining segment in accordance with the invention.

In order to mount the retaining segment 17, 38 on the pivoting cradle 5 screw connections 18 are provided as already explained with reference to FIGS. 1 and 2. Bores 50, 51 are formed in the retaining segment 17, 38 in order to receive the screws 18. The bores 50, 51 pass through the retaining segment 17, 38 and are formed in the proximity of the first end 45 and of the second end 46. In the exemplified embodiment shown in FIG. 3 a pressure medium supply point 52 is provided as well. The pressure medium supply point 52 is connected to the mounting surface 49 via a pressure medium channel 53 so that pressure medium can be supplied as far as the mounting surface 49 via the pressure medium supply point 52. This is shown in FIG. 4 which illustrates a cross-section through the retaining segment 17, 38 in accordance with the invention. The pressure medium bore 53 extends from the first end 45 of the retaining segment 17, 38 to the pressure medium receiver 52. In so doing it passes through the bore 51 and is connected to a transverse bore 54. At a corresponding site to the transverse bore 54 a further pressure medium channel is formed in the pivoting cradle 5. This is clarified further hereinafter with reference to FIG. 6. By means of this duct system, pressure medium, which is supplied to the pressure medium supply point 52 via a pressure medium line not shown in the drawings, can be supplied to the bearing regions of the pivoting cradle 5. However, an alternative embodiment is preferably used in which the pressure medium channel 53 is connected to the spherical recess 20. The pressure medium supplied to the pivoting cradle 5 is therefore removed from the pressure chamber 13 by the adjusting piston 11.

Figure 5:
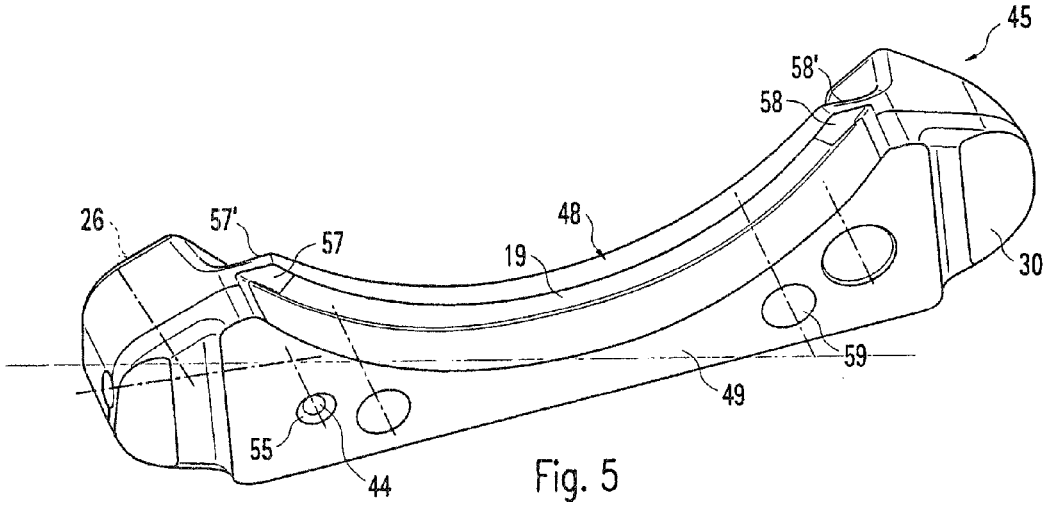
FIG. 5 shows a third perspective view of the retaining segment in accordance with the invention of FIG. 3.

FIG. 5 shows a third perspective view of the retaining segment 17, 38 in accordance with the invention. In particular it is possible to see therein that the retaining surface 19 is formed in the region of the curvature 48. The retaining surface 56 is introduced into the retaining segment 17, 38 from the side of the mounting surface 49, for example by means of a circular milled area. The retaining segment 56 is formed plane-parallel to the mounting surface 49. During operation of the axial piston machine 1 the recoil plate rotates with the slide shoes fixed therein and lies against the retaining surface 19 with its surface remote from the running surface 6 of the pivoting cradle 5. The retaining segments 17, 38 fixedly connected to the pivoting cradle 5 via the screw connections therefore keep the recoil plate at a maximum distance from the running surface 6 of the pivoting cradle 5 by means of a positive-locking connection. During operation a lubricant film is formed between the retaining surface 5 and the surface of the recoil plate 7. At least one inclined surface 57 or 58 is formed on the retaining surface 19 in order to improve the inlet of lubricant during operation and therefore also to improve the start-up behaviour of the axial piston machine 1 and to reduce wear.

The retaining surface 19 extends along a portion of a circular arc. The angle of contact of the retaining surface 56 is about 90 degrees. The inclined surface 57 is formed in such a way that the distance from the mounting surface 49 increases towards the end 57' of the retaining surface 56. A wedge-shaped intermediate space is thus produced between the retaining surface 56 in the region of the at least one inclined surface 57 and the recoil plate 7. A lead-in slope is thus produced which favours the entry of lubricant into the intermediate space between the retaining surface 19 and the recoil plate 7. Provided that the axial piston machine 1 is arranged for operation in both rotational directions it is preferred to provide an inclined surface 57, 58 such as this on both ends of the retaining segment 17, 38, as illustrated in FIG. 5. The second inclined surface 58 on the other end 58' is formed corresponding to the first inclined surface 57.

Furthermore, FIG. 5 clearly shows the further stop surface 30. The stop surface 30 is formed on the same end 45 as the receiver for the actuating device. The stop surface 30 is thus oriented substantially in the direction of the mounting surface 49 but extends in an inclined manner with respect thereto. The angle formed by the stop surface 30 with respect to the mounting surface 49 is dependent on the maximum pivoting angle at which the further stop surface 30 should cooperate with a counterpart of the housing of the axial piston machine 1 to form a safety stop.

Alignment pins are provided in order to fix and centre the retaining segments 17, 38, as already explained with reference to FIG. 1. In order to receive the alignment pin, a centring bore 59 is introduced into the retaining segment 17, 38 from the mounting surface 49.

Figure 6:
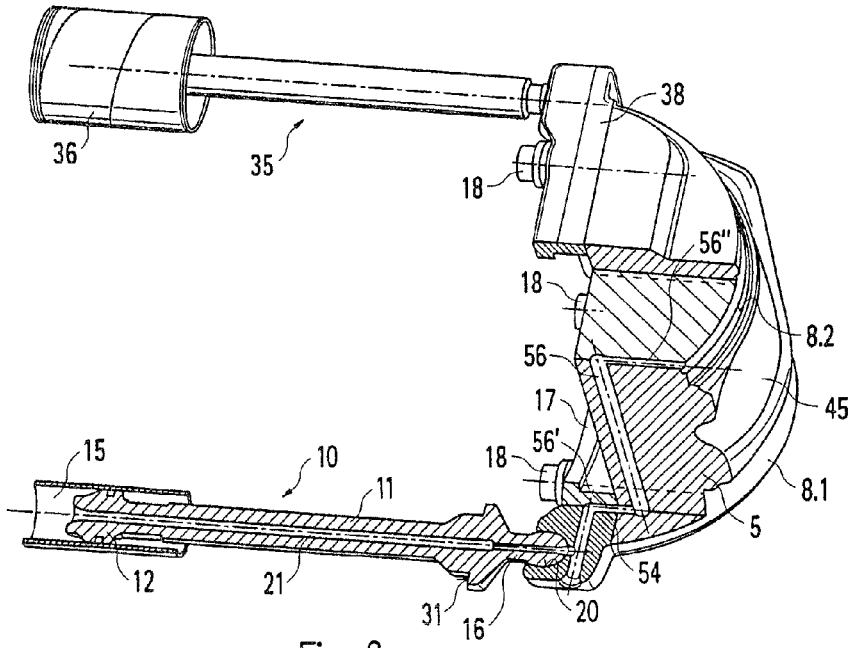
FIG. 6 shows a further illustration of the adjustment system with a retaining segment in accordance with the invention in a partially cut away view.

FIG. 6 shows a partial cross-section through components of the adjusting system of the axial piston machine 1 in accordance with the invention. The course of the pressure channels in the first retaining segment 17 and further in the pivoting cradle 5 is shown in particular. The preferred embodiment is illustrated, according to which the pressure medium channel in the retaining segment 17, 38 is connected to the spherical recess 20 of the ball-and-socket joint connection. By means of the transverse bore 54 the pressure medium is then supplied to the pivoting cradle 5. A further pressure medium channel 56 is disposed in the pivoting cradle 5 and is connected via an inlet bore 56' to the transverse bore 54 of the retaining segment 17, 38. The further pressure medium channel 56 is connected to a first and to a second bearing surface bore, wherein only the second bearing surface bore 56" can be seen in FIG. 6. In that case, the pressure medium exits, for example, in a groove provided in the second bearing surface.

Figure 7:
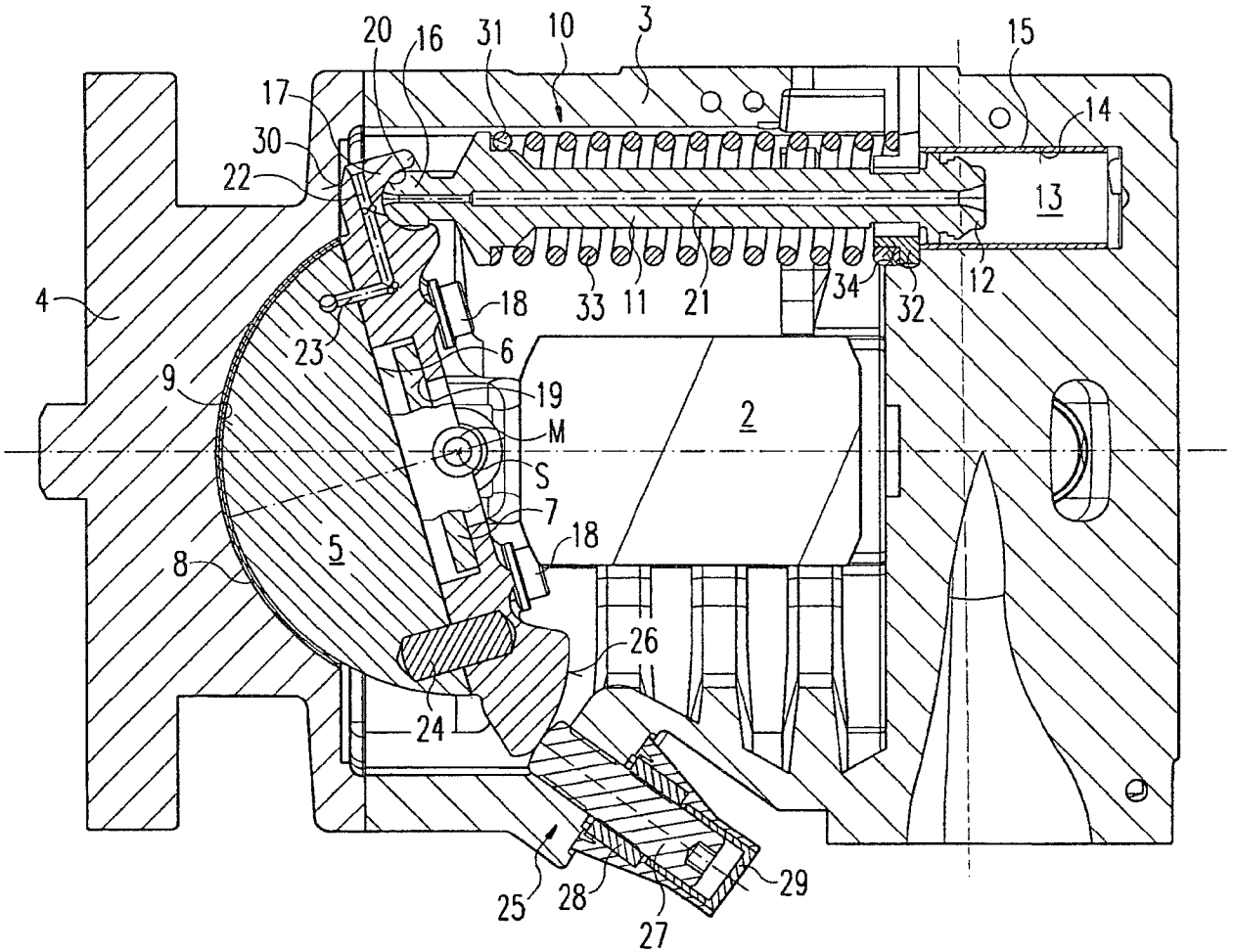
FIG. 7 shows a further illustration for clarification of possible pivoting angle detection by means of a magnet disposed in the region of the pivot axis.

FIG. 7 shows that a magnet M is disposed on the retaining segment 17 in the region of the pivot axis or coinciding with the pivot axis. With the aid of this magnet, changes in the angle of rotation and therefore the positions of the pivoting cradle 5 can easily be detected. A Hall sensor, for example, can be disposed in the region of the magnet for detection purposes and detects rotation thereof in a contact-free manner. The magnet M can either be disposed on the retaining segment 17 or can also even be incorporated therein, for example in that a magnet is inserted into a recess in the retaining segment provided for this purpose.

Figure 8:
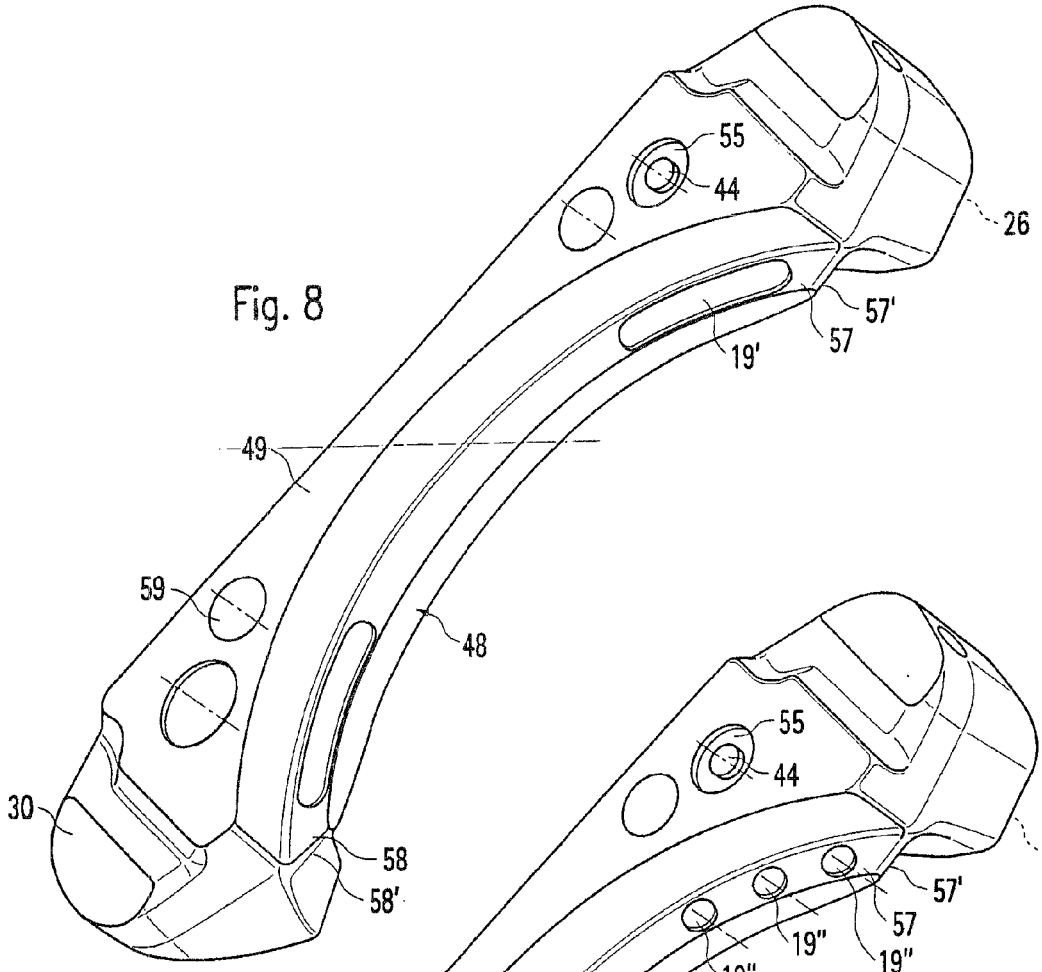
FIG. 8 shows an alternative embodiment of a retaining surface on the retaining segment.
Figure 9:
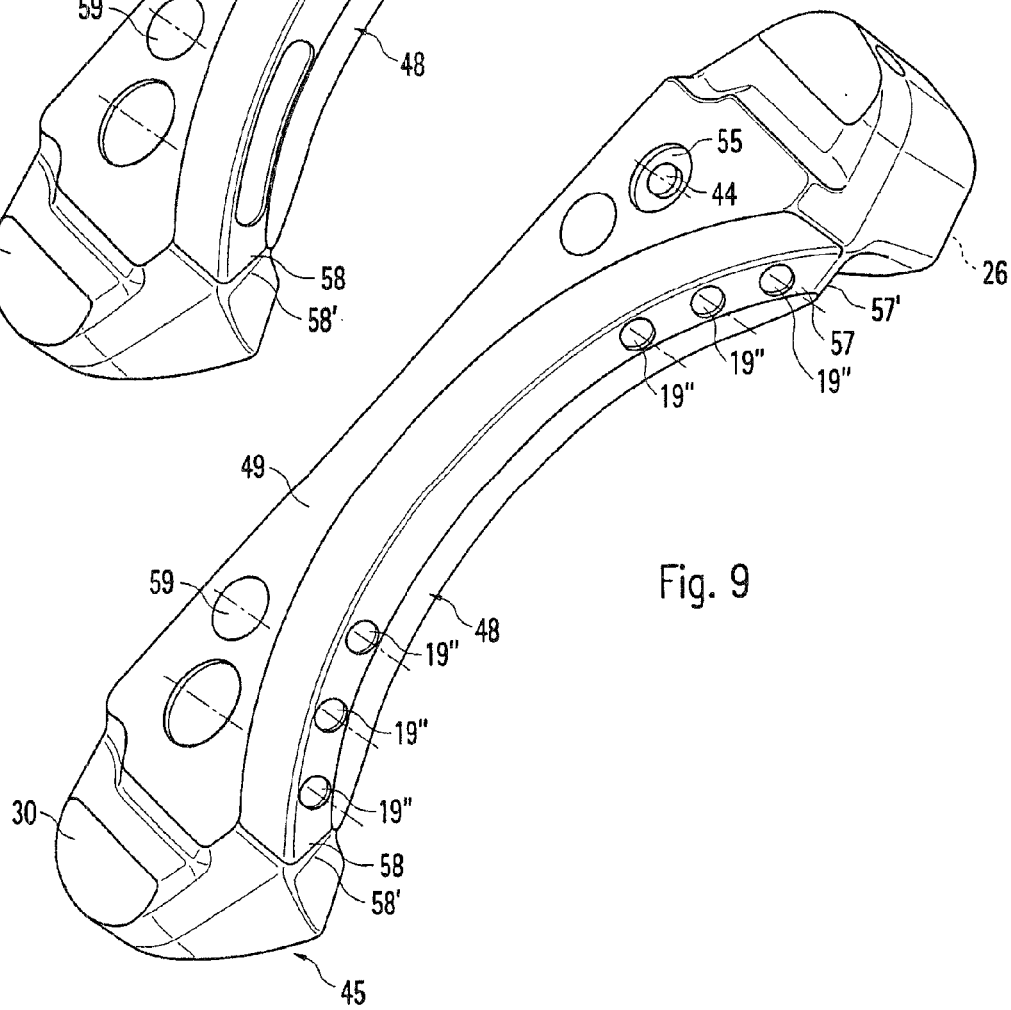
FIG. 9 shows a still further embodiment of a retaining surface on the retaining segment.

FIGS. 8 and 9 show exemplified embodiments for alternative formations of the retaining surfaces 19' and 19". In the example of FIG. 8 the retaining surface is not formed over the entire longitudinal extension of the retaining segment 17. It is rather the case that regions are formed which are embossed with respect to the retaining segment 17 functioning as a support. Such embossed retaining surfaces 19' or 19" are preferably formed from brass or bronze material. They can alternatively also be produced from a synthetic material. The retaining surfaces 19' or 19" serve as sliding partners for the recoil plate 7 and can be, for example, flame sprayed. This is shown by way of example in FIG. 8. Alternative methods of attachment include, for example in the case of metal retaining surfaces 19", riveting to the retaining segment 17 as a supporting element. It is particularly preferred if the retaining surface 19' or 19" is disposed towards the first end or towards the second end. The forces are thereby introduced closer to the region where the retaining segment 17 is fixed to the pivoting cradle 5, thus largely preventing bending of the retaining segment 17.

The invention is not limited to the illustrated exemplified embodiments. In particular it is possible to combine individual features of the illustrated exemplified embodiments with each other in an advantageous manner.

The invention claimed is:

1. A retaining segment for retaining a recoil plate of a hydrostatic piston machine having a receiver for an actuating element of an adjusting device and a retaining surface which extends along a portion of a circular arc, wherein at least one stop surface is formed on the retaining segment; and wherein the stop surface and the receiver for an actuating element are formed on opposing ends of the retaining segment and are oriented towards a side remote from a mounting surface.

2. The retaining segment as claimed in claim 1, wherein the stop surface is formed in a crown-shaped manner, wherein the centre point of the crowning lies on the side of the stop surface facing the mounting surface.

3. The retaining segment as claimed in claim 1, wherein a further stop surface is formed on the retaining segment and is disposed on the same end as the receiver for the actuating device.

4. The retaining segment as claimed in claim 3, wherein the receiver and the further stop surface are oriented in opposite directions on the retaining segment.

5. The retaining segment as claimed in claim 1, wherein the retaining segment comprises nitrocarburized steel and is oxidized.

6. The retaining segment as claimed in claim 5, wherein the retaining segment has the retaining surface which is formed from a brass or bronze material.

7. The retaining segment as claimed in claim 5, wherein the retaining segment has the retaining surface which is formed from a synthetic material substance.

8. The retaining segment as claimed in claim 1, wherein the retaining segment comprises at least one of brass, bronze and synthetic material.

9. A retaining segment for retaining a recoil plate of a hydrostatic piston machine having a receiver for an actuating element of an adjusting device and a retaining surface which extends along a portion of a circular arc, wherein at least one stop surface is formed on the retaining segment; and wherein the portion of the circular arc corresponds to a circle segment with an opening angle of about 90°.

10. The retaining segment as claimed in claim 9, wherein an inclined surface portion is formed on at least one end of the retaining surface so that a distance between the mounting surface and the retaining surface increases towards the end of the retaining surface.

11. The retaining segment as claimed in claim 10, wherein at least one pressure medium channel is formed in the retaining segment and connects the receiver for the actuating device to the mounting surface.

12. A retaining segment for retaining a recoil plate of a hydrostatic piston machine having a receiver for an actuating element of an adjusting device and a retaining surface which extends along a portion of a circular arc, wherein at least one stop surface is formed on the retaining segment; and wherein the retaining segment is fitted with a magnet which serves to detect a pivoting angle of a pivoting cradle.

13. The retaining segment as claimed in claim 12, wherein the magnet is connected to the retaining segment and is disposed in a pivot axis or in the proximity of the pivot axis.

* * * * *